US010704178B2

(12) United States Patent
Jung et al.

(10) Patent No.: US 10,704,178 B2
(45) Date of Patent: Jul. 7, 2020

(54) LAUNDRY TREATING APPARATUS HAVING A PUMP BODY SUPPORT LEG INCLUDING A RIGID HEAD AND A DEFORMABLE STEM

(71) Applicant: LG ELECTRONICS INC., Seoul (KR)

(72) Inventors: Sungwoon Jung, Seoul (KR); Hunjun Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 306 days.

(21) Appl. No.: 15/287,843

(22) Filed: Oct. 7, 2016

(65) Prior Publication Data

US 2017/0101733 A1 Apr. 13, 2017

(30) Foreign Application Priority Data

Oct. 7, 2015 (KR) ..... 10-2015-0140815

(51) Int. Cl.

| | |
|---|---|
| ***D06F 37/22*** | (2006.01) |
| ***D06F 39/08*** | (2006.01) |
| ***F04B 53/00*** | (2006.01) |
| ***D06B 1/02*** | (2006.01) |
| *D06F 39/12* | (2006.01) |
| *D06F 37/20* | (2006.01) |

(52) U.S. Cl.

CPC ..... *D06F 37/22* (2013.01); *D06B 1/02* (2013.01); *D06F 39/085* (2013.01); *F04B 53/003* (2013.01); *F04B 53/004* (2013.01); *D06F 37/20* (2013.01); *D06F 39/083* (2013.01); *D06F 39/12* (2013.01)

(58) Field of Classification Search

None

See application file for complete search history.

(56) References Cited

U.S. PATENT DOCUMENTS

| | | | |
|---|---|---|---|
| 2006/0000240 | A1 | 1/2006 | Song |
| 2010/0095713 | A1 | 4/2010 | Yim et al. |

FOREIGN PATENT DOCUMENTS

| | | |
|---|---|---|
| CN | 200999822 | 1/2008 |
| CN | 103031699 | 4/2013 |
| CN | 10-4047149 | 9/2014 |

(Continued)

OTHER PUBLICATIONS

Chinese Office Action (with English translation) dated Aug. 16, 2018 issued in CN Application No. 201610881060.8.

(Continued)

*Primary Examiner* — Rita P Adhlakha

(74) *Attorney, Agent, or Firm* — Ked & Associates, LLP

(57) ABSTRACT

Provided is a laundry treating apparatus in which vibrations are reduced. The laundry treating apparatus includes a tub holding washing water, a drum rotatably disposed within the tub and holding laundry, a nozzle jetting the washing water to an interior of the drum, a pump unit having a pump body, a drain pump coupled to the pump body and outwardly draining washing water introduced from the interior of the tub to the pump body, and a circulation pump coupled to the pump body and supplying washing water introduced from the interior of the tub to the pump body to the nozzle, a cabinet accommodating the tub, the drum, the nozzle, and the pump unit therein, and a mount coupled to the pump body and the cabinet to absorb vibrations.

20 Claims, 11 Drawing Sheets

(56) References Cited

FOREIGN PATENT DOCUMENTS

| | | |
|---|---|---|
| DE | 2 157 590 | 5/1973 |
| DE | 3 917 349 | 1/1990 |
| EP | 2 918 721 | 9/2015 |
| JP | 2003-074525 | 3/2003 |
| JP | 2007-143736 | 6/2007 |
| JP | 2009-219598 | 10/2009 |
| KR | 10-0715044 | 5/2007 |
| KR | 10-2007-0103791 | 10/2007 |
| KR | 10-0786680 | 12/2007 |
| KR | 10-0829192 | 5/2008 |
| KR | 10-2012-0108473 | 10/2012 |
| KR | 10-1460134 | 11/2014 |

OTHER PUBLICATIONS

European Search Report dated Jan. 13, 2017 issued in Application No. 16 19 2820.5.

PCT International Search Report dated Feb. 15, 2017 issued in Application No. PCT/KR2016/011256.

LAUNDRY TREATING APPARATUS HAVING A PUMP BODY SUPPORT LEG INCLUDING A RIGID HEAD AND A DEFORMABLE STEM

CROSS-REFERENCE TO RELATED APPLICATIONS

This application claims priority under 35 U.S.C. § 119 to Korean Patent Application No. 10-2015-0140815 filed on Oct. 7, 2015, whose entire disclosure is hereby incorporated by reference.

BACKGROUND

1. Field

The present application relates to a laundry treating apparatus and, more particularly, to a laundry treating apparatus performing washing in a manner of lifting and dropping laundry.

2. Background

In general, a washing machine is classified as a top load washing machine performing washing using swirl water stream of washing water and a drum washing machine performing washing in a manner of lifting and dropping laundry.

That is, in the top load washing machine, an inner tub, a washing tub, is disposed to rotate in a direction perpendicular to a ground, a pulsator provided on a bottom surface of the inner tub rotates to generate a water stream, and the water stream rubs against laundry or the pulsator applies an impact to laundry to perform washing. In contrast, in the drum washing machine, an inner tub, a washing tub, is disposed to rotate in a direction parallel to a ground, and as the inner tub rotates, laundry rubs against an inner wall surface of the inner tub or drops to perform washing.

In the drum washing machine, the drum is rotatably installed within the tub, a water storage tank. Also, a drain pump and a circulation pump are installed in the drum washing machine. The drain pump serves to drain washing water within the tub outwardly during a draining operation. The circulation pump serves to circulate washing water within the tub to an interior of the drum during washing operation.

The circulation pump is connected to an injection nozzle installed in a top cover, an upper panel of the drum washing machine, through a circulation flow channel to supply washing water within the tub to the injection nozzle, whereby the injection nozzle may inject the supplied washing water to the drum to allow laundry within the drum to be evenly wet.

Recently, a pump unit in which the drain pump and the circulation pump are integrally coupled to a pump body is used. The pump unit is fastened to a mounting plate through a screw. Also, a mount formed of rubber is installed in a corner portion of the mounting plate in order to absorb vibrations of the pump unit, and the mount is fastened to a base cover, a bottom panel of the drum washing machine, through a screw.

Thus, the related art laundry treating apparatus has a narrow component installation space due to the mounting plate and the plurality of screws and is costly.

BRIEF DESCRIPTION OF THE DRAWINGS

The embodiments will be described in detail with reference to the following drawings in which like reference numerals refer to like elements wherein.

DETAILED DESCRIPTION

Hereinafter, a laundry treating apparatus according to an embodiment of the present disclosure will be described with reference to the accompanying drawings.

Figure 1:
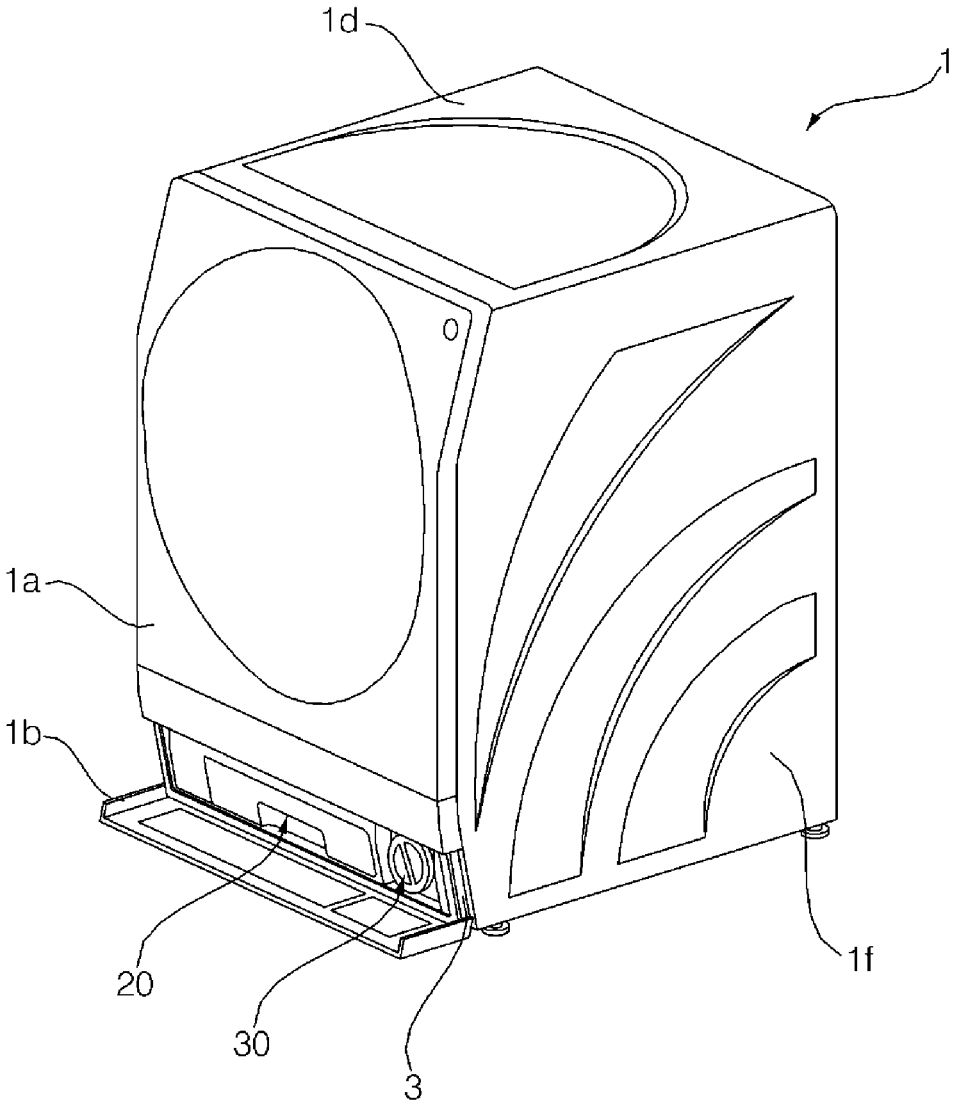
FIG. 1 is a view illustrating an appearance of a laundry treating apparatus according to an embodiment of the present disclosure.
Figure 2:
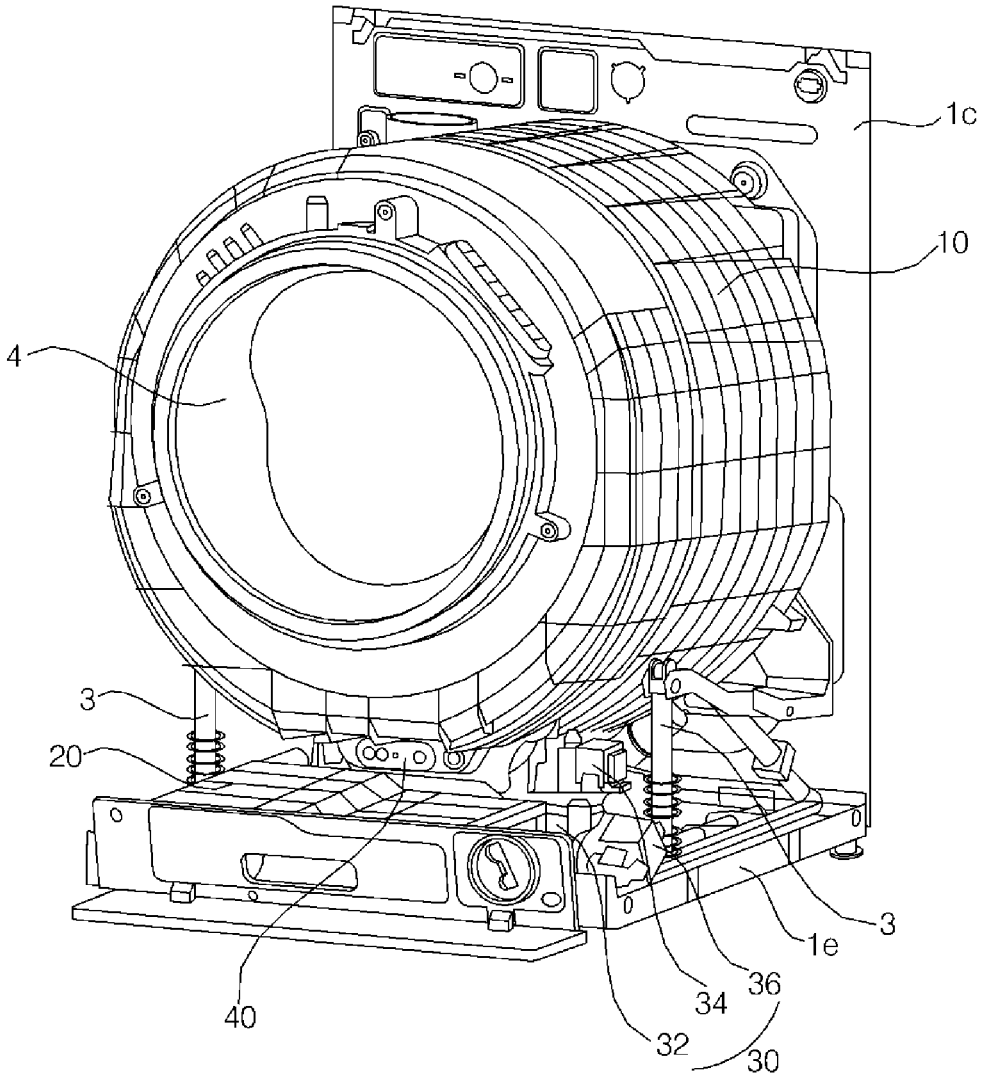
FIG. 2 is a view illustrating an internal configuration of the laundry treating apparatus of FIG. 1.

FIG. 1 is a view illustrating an appearance of a laundry treating apparatus according to an embodiment of the present disclosure, and FIG. 2 is a view illustrating an internal configuration of the laundry treating apparatus of FIG. 1.

Referring to FIGS. 1 and 2, the laundry treating apparatus according to an embodiment of the present disclosure includes a tub 10, an automatic injection device 20 disposed below the tub 10, and a pump unit (or assembly) 30 disposed on one side of the automatic injection device 20. The tub 10, the automatic injection device 20, and the pump unit 30 are accommodated within a cabinet 1 forming an appearance of the laundry treating apparatus.

The cabinet 1 may be formed in a quadrangular hexahedron having an internal space in which the tub 10, the automatic injection device 20, and the pump unit 30 are accommodated, and here, the quadrangular hexahedron of the cabinet 1 may be formed by assembling a plurality of panels. That is, the cabinet 1 may include front covers 1*a* and 1*b* forming a front surface, a back cover 1*c* forming a rear surface, a top cover 1*d* forming an upper surface, a base cover 1*e* forming a bottom surface, and side covers 1*f* forming both side surfaces.

The front covers 1*a* and 1*b* may include a first front cover 1*a* disposed on a front side of the tub 10 and a second front cover 1*b* disposed on a front side of the automatic injection device 20 and the pump unit 30 and disposed on a lower side of the first front cover 1*a*. Both sides of a lower end portion of the second front cover 1*b* may be hinge-coupled to the frame 3 so as to be opened and closed. When the second front cover 1*b* is opened, the automatic injection device 20 and the pump unit 30 are exposed, and when the second front cover 1*b* is closed, the automatic injection device 20 and the pump unit 30 are invisible.

The tub holds washing water and is disposed within the cabinet 1 such that lower portions thereof are supported by dampers 3 installed on the base cover 1*e*. Two dampers 3 may be provided to support both sides of the tub 10.

A drum (not shown) holding laundry is rotatably disposed within the tub 10. The drum is disposed such that a rotational axis thereof is horizontal to a ground, and the drum is disposed to rotate centered on the rotational axis.

A front side of the tub 10 and a front side of the drum are opened and laundry may be introduced to an interior of the drum through the opened front side of the tub 10 and the opened front side of the drum. The first front cover 1*a* is opened to correspond to the opened front side of the tub 10 and the opened front side of the drum, and a door (not shown) opening and closing the opened front side of the tub 1 and the opened front side of the drum may be installed on the opened portion of the front cover 1*a*, and a door glass 4 may be coupled to an inner side of the door. The door glass 4 may protrude backwardly on an inner side of the door, so that when the door is closed, the door glass 4 is inserted into the opened front side of the tub 10 and the opened front side of the drum. The door glass 4 may be formed of a transparent material such that the interior of the drum is checked with naked eyes.

A heater 40 heating washing water within the tub 10 is installed below the tub 10. The heater 40 may be disposed between the tub 10 and the automatic injection device 20. The heater 40 may operate or may not operate according to a washing course. That is, the heater 40 may operate at a specific washing course to heat washing water within the tub 10.

A plurality of water holes communicating with the tub 10 may be formed on a circumferential surface of the drum, so that washing water within the tub 10 may enter the drum through the water holes. For example, when the tub 10 is filled with washing water to a predetermined height, the washing water within the tub 10 may be introduced to an interior of the drum to wet laundry of the drum.

A plurality of lifters for lifting and dropping the laundry during a rotation of the drum may be installed on an inner circumferential surface of the drum. That is, the laundry held in the drum may be lifted by the lifters and subsequently dropped so as to be washed.

The automatic injection device 20 may serve to store at least one of a liquid detergent and a liquid softening agent and inject a recommended amount of at least one of the liquid detergent and the liquid softening agent appropriate for a washing load to the interior of the tub 10. Here, the washing load may be a load applied to a motor rotating the drum. The automatic injection device 20 may be spaced apart downwardly from the tub 10 and coupled to an upper surface of the base cover 1*e*.

The pump unit 30 is disposed on one side of the automatic injection device 20 and coupled to an upper surface of the base cover 1*e*. The pump unit 30 includes a pump body 32, a circulation pump 34, and a drain pump 36.

The circulation pump 34 circulates washing water introduced to an interior of the pump body 32 from the interior of the tub 10 to an interior of the drum during a washing operation, and the drain pump 36 drains washing water introduced from the interior of the tub 10 to the pump body 32 outwardly during a draining operation.

Figure 3:
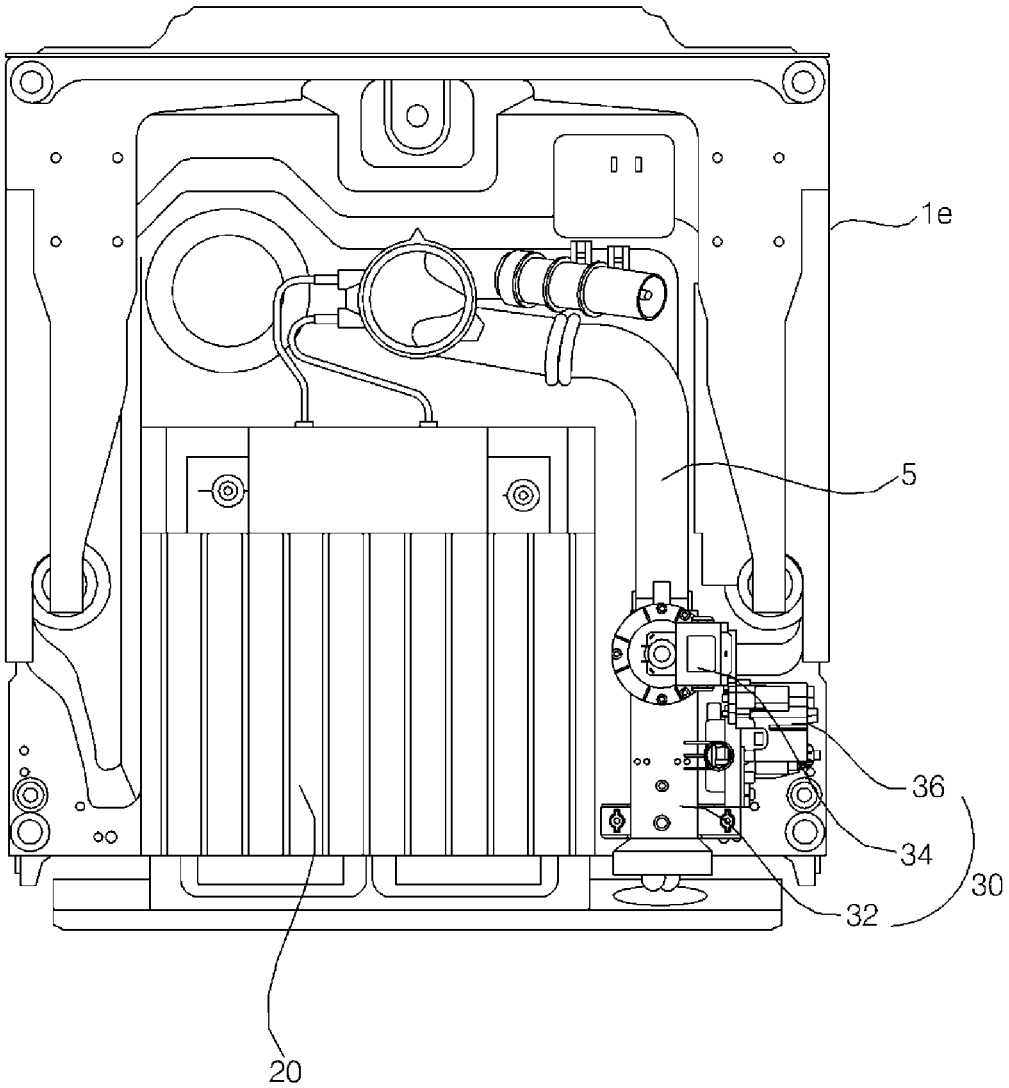
FIG. 3 is a view illustrating a configuration below a tub illustrated FIG. 2, viewed from above.

FIG. 3 is a view illustrating a configuration below the tub illustrated FIG. 2, viewed from above.

Referring to FIGS. 1 to 3, one end of the pump body 32 is coupled to the tub 10 through a connection flow channel 5. That is, one end of the connection flow channel 5 may be coupled to the tub 10 and the other end thereof may be coupled to the pump body 32 so that washing water within the tub 10 may be supplied to the pump body 32.

When viewed from a front side of the laundry treating apparatus, the pump unit 30 is disposed on the right side of the automatic injection device 20. The circulation pump 34 is disposed on an upper side of the pump body 32, and the drain pump 36 is disposed on the right side of the pump body 32 opposite to the automatic injection device 20. When viewed from the front side of laundry treating apparatus, the pump body 32 extends in a forward/backward direction, and the circulation pump 34 is disposed on a rear side than the drain pump 36 in a length direction of the pump body 32 and disposed on an upper side of the pump body 32. The drain pump 36 is disposed on a front side than the circulation pump 34 in the length direction of the pump body 32 and disposed on the right side of the pump body 32.

As the circulation pump 34 is installed in a higher position, a flow rate circulating within the drum is increased. Thus, preferably, the circulation pump 34 is installed on an upper side of the pump body 32. Also, as the circulation pump 34 is installed on an upper side of the pump body 32, a space allowing the automatic injection device 20 to be installed on one side of the pump unit 30 may be secured.

Figure 4:
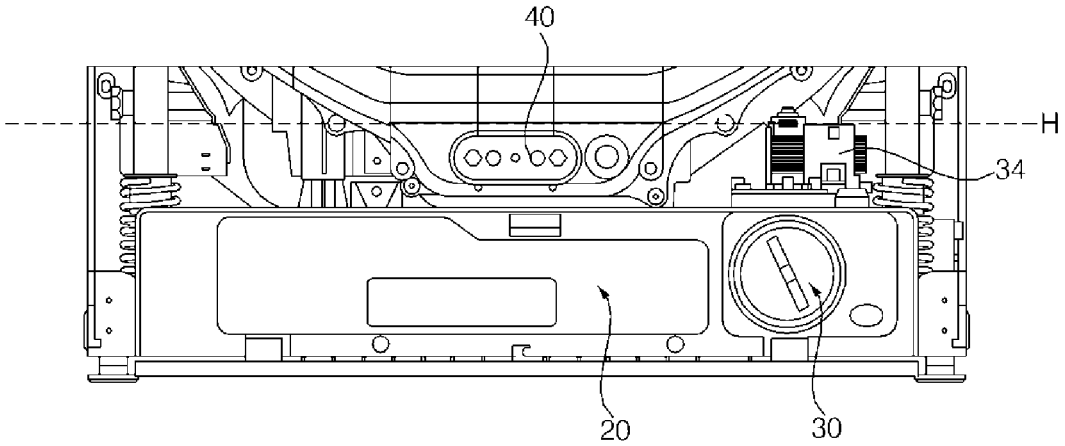
FIG. 4 is a view illustrating a position relation of a circulation pump and a heater illustrated in FIG. 2.

FIG. 4 is a view illustrating a position relation of a circulation pump and a heater illustrated in FIG. 2.

Referring to FIGS. 1 to 4, as mentioned above, the heater 40 serves to heat washing water within the tub 10 in a specific washing course. Thus, in order for the heater 40 to heat washing water within the tub 10 and in order to prevent damage to the heater 40 due to heating, a lowest water level H of washing water within the tub 10 is required to be in a position higher than the heater 40 during a washing operation in the specific washing course.

If the circulation pump 34 is disposed in a position higher than a lowest water level H, it cannot circulate washing water within the tub 10, and thus, preferably, the circulation pump 34 is disposed above the pump body 32 and disposed below the lowest water level H.

Figure 5:
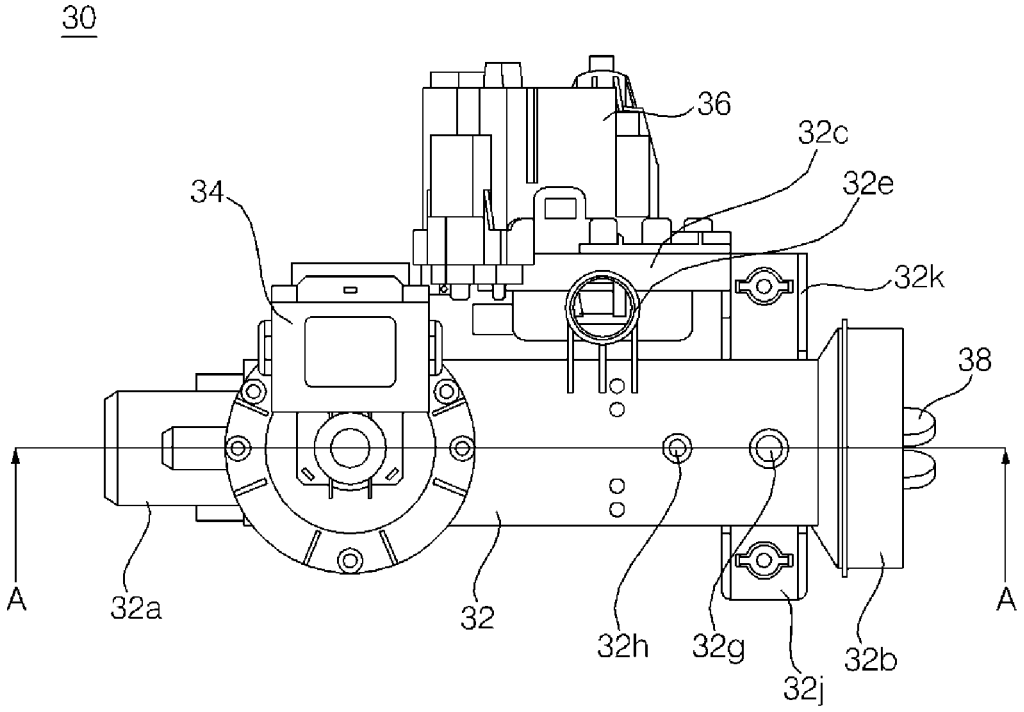
FIG. 5 is a top view of a pump unit illustrated in FIG. 2.
Figure 6:
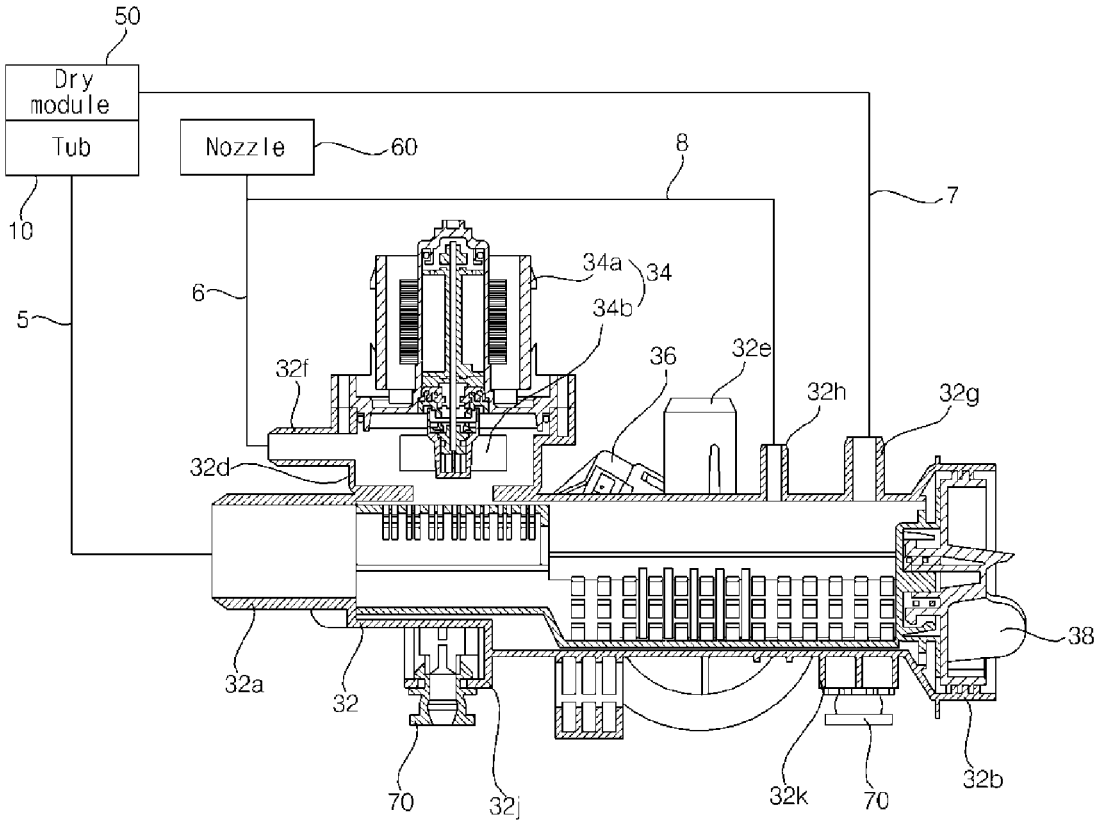
FIG. 6 is a cross-sectional view taken along line A-A of FIG. 5.
Figure 7:
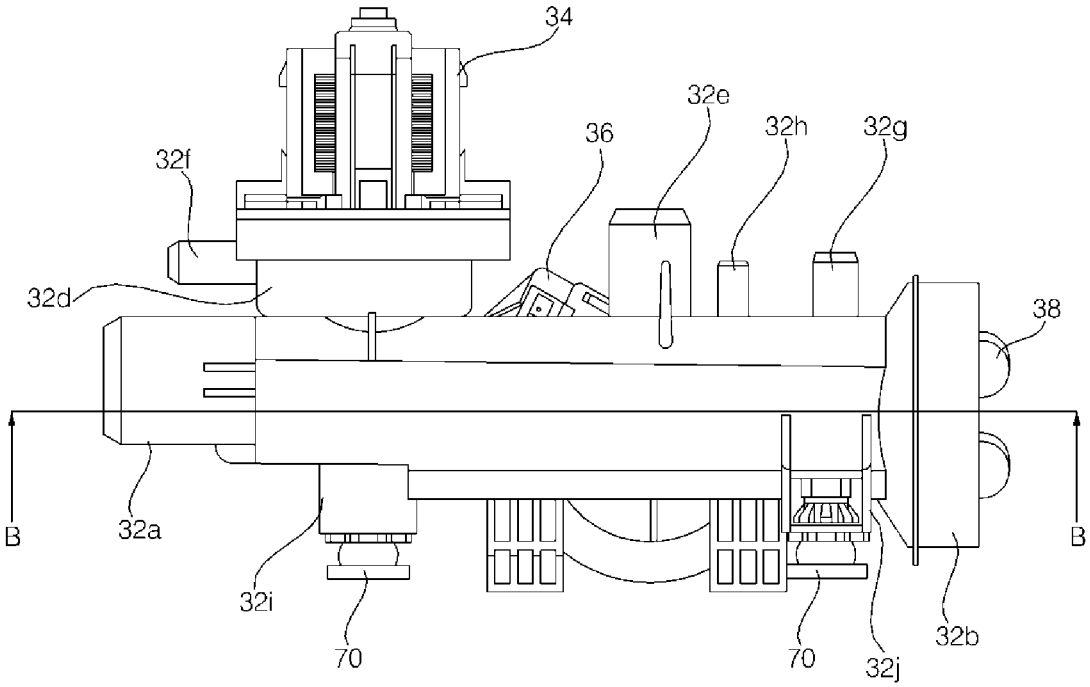
FIG. 7 is a side view of the pump unit illustrated in FIG. 2.
Figure 8:
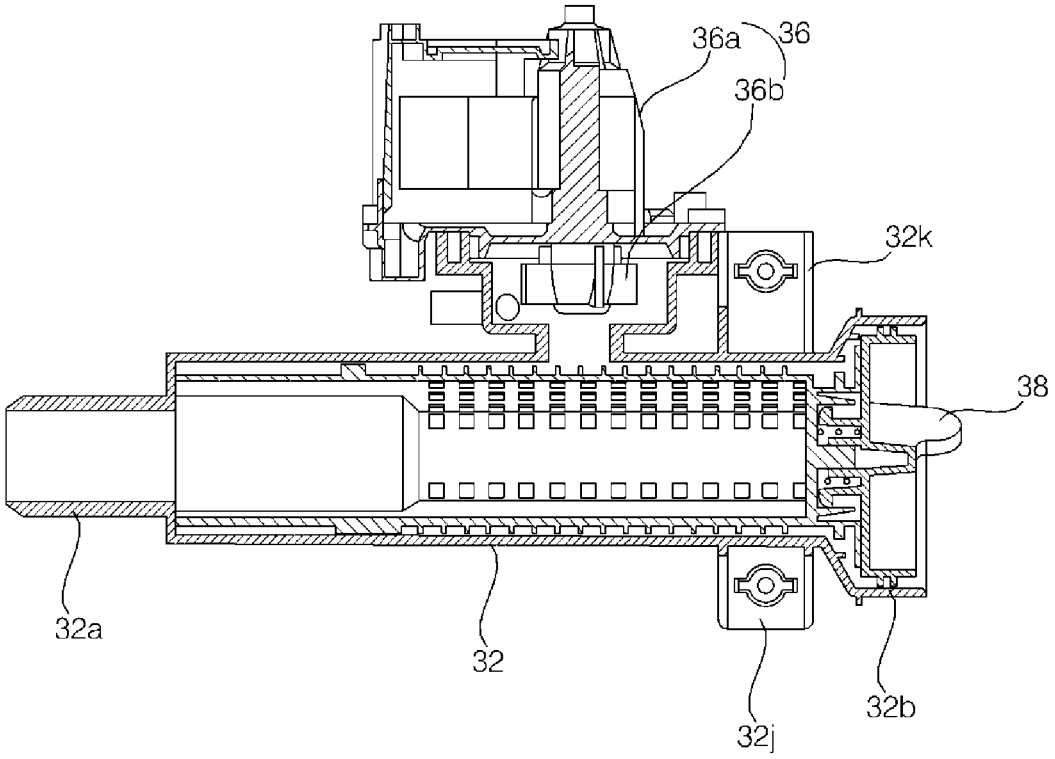
FIG. 8 is a cross-sectional view taken along line B-B of FIG. 7.

FIG. 5 is a top view of a pump unit illustrated in FIG. 2, FIG. 6 is a cross-sectional view taken along line A-A of FIG. 5, FIG. 7 is a side view of the pump unit illustrated in FIG. 2, and FIG. 8 is a cross-sectional view taken along line B-B of FIG. 7.

Referring to FIGS. 1 to 8, a dry module (or dryer) for drying laundry within the drum is further installed above the tub 10, and a nozzle 60 jetting washing water to the interior of the drum is installed on the top cover 1*d* of the cabinet 1. The dry module 50 and the nozzle 60 are accommodated in the cabinet 1.

The pump body 32 has an inlet portion 32*a* formed at one end thereof in a length direction and allowing washing water from the interior of the tub 10 to be introduced therethrough, and a filter insertion portion 32*b* formed at the other end thereof in the length direction to allow a filter 38 to be inserted thereinto. The inlet portion 32*a* and the filter insertion portion 32*b* are coaxially disposed.

The inlet portion 32*a* may be connected to the tub 10 through the connection flow channel 5 so that washing water within the tub 10 may be introduced thereto. That is, one end of the connection flow channel 5 is coupled to the tub 10 and the other end thereof is coupled to the inlet portion 32*a*. The filter insertion portion 32*b* may have the largest diameter, compared with other portions of the pump body 32. The filter 38 is inserted into the pump body 32 through the filter insertion portion 32*b* to filter out a foreign object from washing water within the pump body 32. Only a handle portion of the filter 38 is disposed within the filter insertion portion 32*b*.

The drain pump 36 and the circulation pump 34 are coupled to an outer circumferential surface of the pump body 32. A drain pump coupling portion 32*c* to which the drain pump 36 is coupled protrudes from the pump body 32 in a radial direction, and a circulation pump coupling portion 32*d* to which the circulation pump 34 is coupled protrudes from the pump body 32 in a radial direction.

When the pump unit 30 is coupled to the base cover 1*e*, the drain pump coupling portion 32*c* protrudes laterally from the pump body 32 and the circulation pump coupling portion 32*d* protrudes upwardly from the pump body 32.

The drain pump coupling portion 32*c* and the circulation pump coupling portion 32*d* are disposed to be spaced apart from each other in a length direction of the pump body 32. Also, the drain pump coupling part 32*c* and the circulation pump coupling part 32*d* are disposed to be perpendicular to each other in a circumferential direction of the pump body 32. Thus, when the drain pump 36 is coupled to the drain pump coupling portion 32*c* and the circulation pump 34 is coupled to the circulation pump coupling portion 32*d*, the drain pump 36 and the circulation pump 34 may be disposed to be spaced apart from each other in a length direction of the pump body 32 and disposed to be perpendicular to each other in a circumferential direction of the pump body 32.

The drain pump 36 includes a drain pump motor 36*a* and a drain pump impeller 36*b* coupled to a rotational shaft of the drain pump motor 36*a*. The drain pump impeller 36*b* is inserted and disposed in the drain pump coupling portion 32*c*, and the drain pump motor 36*a* is coupled to an outer side of the drain pump coupling portion 32*c*. A drain port 32*e* protrudes from an outer circumferential surface of the drain pump coupling portion 32*c* in a radial direction. The drain port 32*e* is disposed to protrude upwardly from the pump body 32. The drain port 32*e* is connected to a drain flow channel (not shown). The drain flow channel drains washing water discharged from the drain port 32*e* to outside of the cabinet 1.

When the drain pump motor 36*a* is driven so the rotational shaft of the drain pump motor 36*a* rotates, the drain pump impeller 36*b* is rotated to intake washing water from the interior of the pump body 32 and discharge the washing water to the drain port 32*e*, and the washing water discharged to the drain port 32*e* may be drained to outside of the cabinet 1 through the drain flow channel.

The circulation pump 34 includes a circulation pump motor 34*a* and a circulation pump impeller 34*b* coupled to a rotational shaft of the circulation pump motor 34*a*. The circulation pump impeller 34*b* is insertedly disposed in the circulation pump coupling portion 32*d*, and the circulation pump motor 34*a* is coupled to an outer side of the circulation pump coupling portion 32*d*. A circulation port 32*f* protrudes from an outer circumferential surface of the circulation pump coupling portion 32*d* in a radial direction. The circulation port 32*f* is disposed above the pump body 32 and parallel to the pump body 32 in a length direction.

The circulation port 32*f* is connected to the nozzle 60 through a circulation flow channel 6. That is, one end of the circulation flow channel 6 is coupled to the circulation port 32*f* and the other end thereof is coupled to the nozzle 60.

When the circulation pump motor 34*a* is driven so the rotational shaft of the circulation pump motor 34*a* is rotated, the circulation pump impeller 34*b* is rotated, whereby the circulation pump impeller 34*b* intakes washing water from the interior of the pump body 32 and discharges the intaken washing water to the circulation port 32*f* and the washing water discharged to the circulation port 32*f* is moved to the nozzle 60 through the circulation flow channel 6, and thus, the nozzle 60 may jet washing water to the interior of the drum. The washing water jetted by the nozzle 60 to the interior of the drum may wet laundry within the drum and may be held within the tub 10 through the water holes formed in the drum.

When the circulation pump 34 is coupled to the circulation pump coupling portion 32*d* and the drain pump 36 is coupled to the drain pump coupling portion 32*c*, the circulation pump impeller 34*b* is disposed on an upper side than the drain pump impeller 36*b*.

A residual water (or leftover water) receiver port 32*g* and an air boss 32*h* are further formed on the pump body 32. The residual water receiver port 32*a* and the air boss 32*h* may communicate with an internal space of the pump body 32 and protrude upwardly from the pump body 32. The residual water receiver port 32*g* has a diameter greater than that of the air boss 32*h*.

The residual water receiver port 32*g* is connected to the dry module 50 through a residual water receiver flow channel 7. That is, one end of the residual water receiver flow channel 7 is coupled to the residual water receiver port 32*g*, and the other end thereof is coupled to the dry module 50. In a process in which the dry module 50 dries the laundry within the drum, condensate water generated in the dry module 50 flows through the residual water receiver flow channel 7 and is subsequently introduced to the interior of the pump body 32 through the residual water receiver port 32*g*, and when the drain pump 36 is driven the condensate water may be discharged to outside of the cabinet 1 through the drain flow channel.

The air boss 32*h* is connected to the circulation flow channel 6 through an air boss flow channel 8. That is, one end of the circulation flow channel 6 is coupled to the air boss 32*h* and the other end thereof is coupled to the circulation flow channel 6 corresponding to a portion between the circulation port and the nozzle 60. The air boss 32*h* allows washing water discharged from the circulation port 32*f* to the circulation flow channel 6 to be smoothly moved to the nozzle 60.

Meanwhile, fastening portions (or fastening mounts) 32*i*, 32*j*, and 32*k* to be coupled to the base cover 1*e* of the cabinet 1 are formed in the pump body 32. The fastening portions 32*i*, 32*j*, and 32*k* include a first fastening portion 32*i* formed on a lower side opposite to the circulation pump 34, a second fastening portion 32*j* protruding to one side from a lower side between the drain pump 36 and the filter insertion portion 32*b*, and a third fastening portion 32*k* protruding from a lower side between the drain pump 36 and the filter insertion portion 32*b* to a lower side.

Vibration displacements were experimented, while changing positions of the first fastening portion 32*i*, the second fastening portion 32*j*, and the third fastening portion 32*k*. Results of the experimentation showed that, when the first fastening portion 32*i* is positioned on a lower side opposite to the circulation pump 34, the second fastening portion 32*j* is positioned to protrude to one side from a lower side between the drain pump 36 and the filter insertion portion 32*b*, and the third fastening portion 32*k* is positioned to protrude to the other side from the lower side between the drain pump 36 and the filter insertion portion 32*b*, a vibration displacement when the drain pump 36 was driven was 0.0044 mm and a vibration displacement when the circulation pump 34 was driven was 0.0053 mm, having the smallest vibration displacements.

A mount (or support leg) 70 absorbing vibration is coupled to each of the first fastening portion 32*i*, the second fastening portion 32*j*, and the third fastening portion 32*k*. Since the first fastening portion 32*i*, the second fastening portion 32*j*, and the third fastening portion 32*k* have the same structure, only the second fastening portion 32*j* will be described as an example, for the purposes of description.

One end of the mount 70 is inserted so as to be coupled to the fastening portion 32*j*, and the other end thereof is mounted on the base cover 1*e* of the cabinet 1 and subsequently coupled to the base cover 1*e* through the fastening member (or fastener) 80 illustrated in FIG. 10. The fastening member 80 may be formed as a screw, and may penetrate through the base cover 1*e* from a lower side of the base cover 1*e* and may subsequently inserted into an opening in the mount 70 to couple the mount 70 to the base cover 1*e*.

Figure 9:
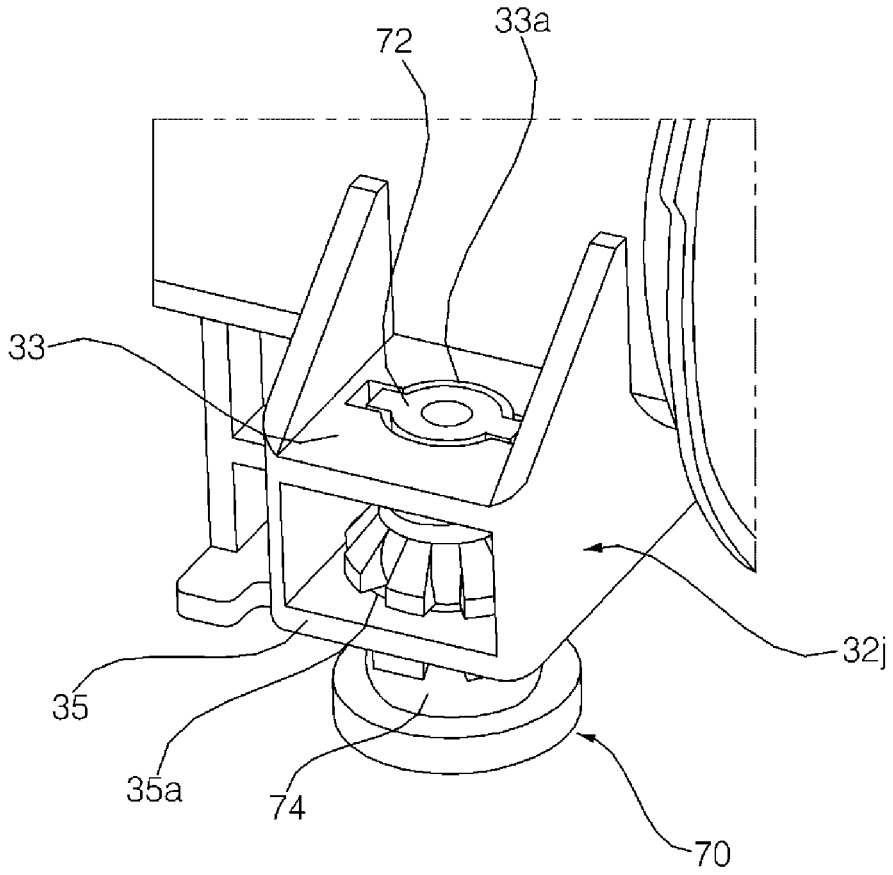
FIG. 9 is a view illustrating a fastening unit of a pump unit.
Figure 10:
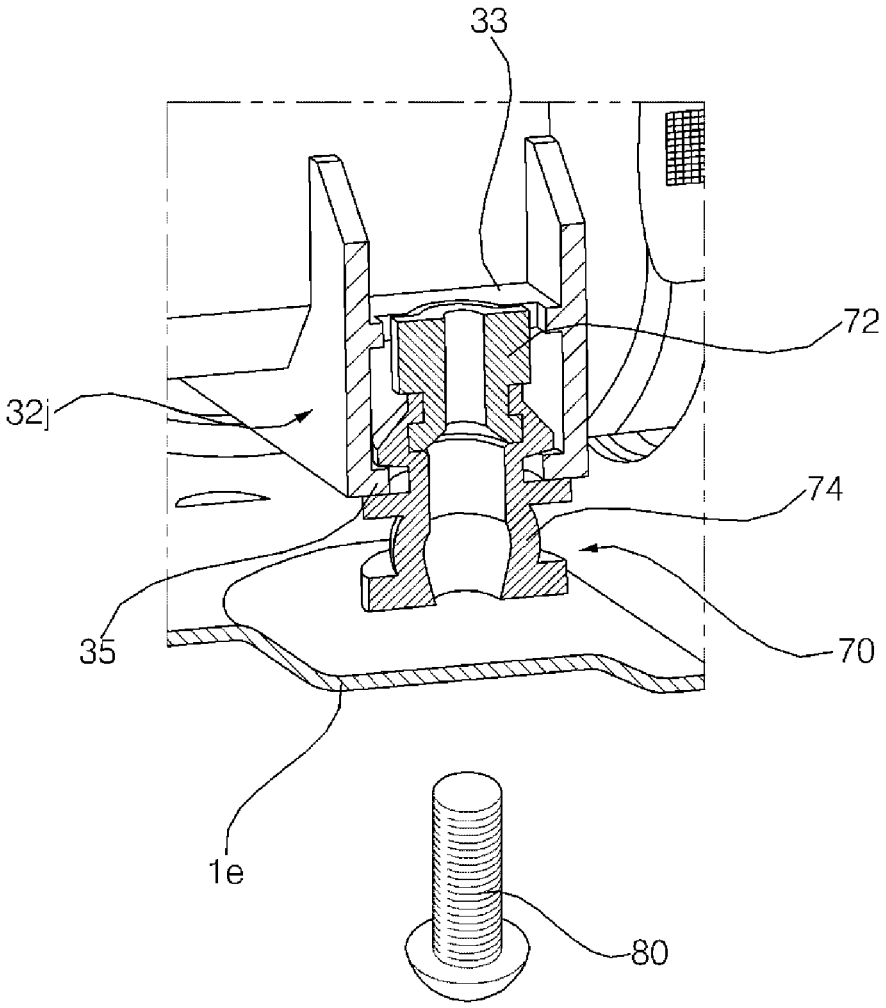
FIG. 10 is a cross-sectional view of FIG. 9.
Figure 11:
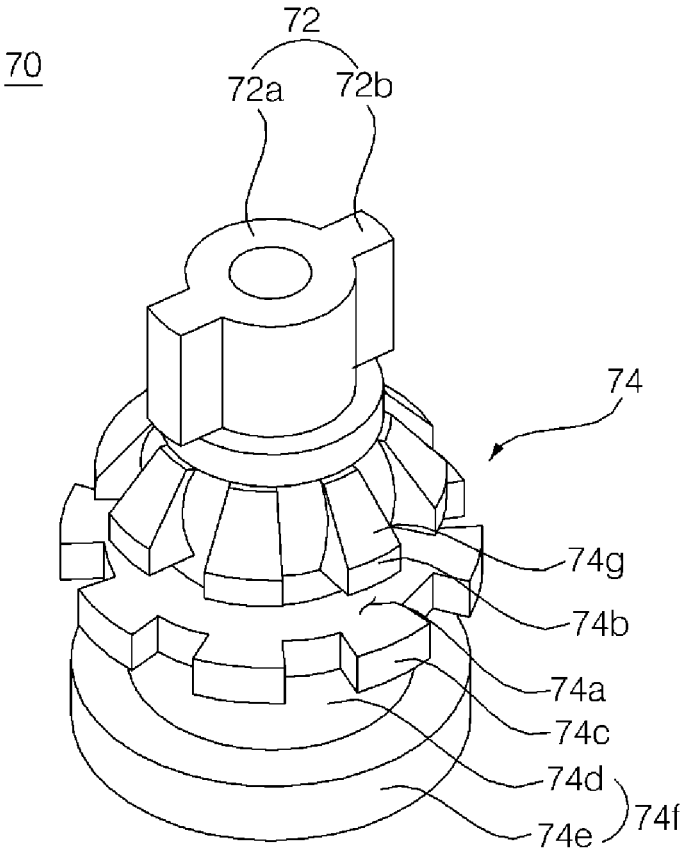
FIG. 11 is a view illustrating a mount of FIG. 9.

FIG. 9 is a view illustrating a fastening unit of a pump unit, FIG. 10 is a cross-sectional view of FIG. 9, and FIG. 11 is a view illustrating a mount of FIG. 9.

Referring to FIGS. 9 to 11, the fastening portion 32*j* includes a first fastening plate 33 and a second fastening plate 35 disposed to be spaced apart from each other vertically. The first fastening plate 33 is disposed above the second fastening plate and the second fastening plate 35 is disposed below the first fastening plate 33. Upper and lower surfaces of the first fastening plate 33 and the second fastening plate 35 are formed as flat surfaces. The first fastening plate 33 and the second fastening plate 35 are disposed to be parallel to each other. A first fastening hole 33*a* is formed in the first fastening plate 33, and a second fastening hole 35*a* is formed in the second fastening plate 35.

An interior of the mount 70 in which the fastening member 80 is inserted is formed to be hollow so that the fastening member 80 is inserted therein and coupled to the base cover 1*e*. The hollow formed in the mount 70 is formed to extend vertically.

The mount 70 includes a hard (or rigid) part (or head) 72 inserted into the first fastening hole 33*a* formed in the first fastening plate 33 and a soft (or deformable) part (or stem) 74 formed to be softer than the hard part 72 and inserted into the second fastening hole 35*a* formed in the second fastening plate 35. The soft part 74 may be formed of rubber, and the hard part 72 may be formed of engineering plastic or steel.

The hard part 72 and the soft part 74 are integrally formed. After the hard part 72 is first molded, when the soft part 74 is molded in a mold pattern, the hard part 72 is put into the mold pattern together to manufacture the mount 70 in an insert-injection method such that the hard part 72 and the soft part 74 are integrally formed.

The hard part 72 includes a circular base portion 72*a* and at least one anti-rotation protrusion portion 72*b* protruding from an outer circumferential surface of the base portion 72*a* in a radial direction. The first fastening hole 33*a* formed in the first fastening plate 33 is formed to have a shape corresponding to a shape of the hard part 72. When the mount 70 is fastened to the base cover 1*e* through the fastening member 80, the anti-rotation protrusion portion 72*b* may be in contact with the first fastening plate 33 within the first fastening hole 33*a*, preventing rotation of the mount 70, whereby the mount 70 may be firmly fastened to the base cover 1*e*.

The soft part 74 includes a groove 74*a* corresponding to the second fastening hole 35*a*, a first arrest portion (or extension) 74*b* formed above the groove 74*a*, a second arrest portion (or extension) 74*c* formed below the groove 74*a*, and a buffer portion (or base) 74*f* extending from the second arrest portion 74*c* downwardly so as to be in contact with the base cover 1*e*.

The groove 74*a* is formed to have a shape corresponding to a shape of the second fastening hole 35*a* and formed along an outer circumferential surface of the mount 70. When the mount 70 is coupled to the fastening portion 32*j*, the second fastening plate 35 is insertedly disposed in a groove 74*a* positioned between the first arrest portion 74*b* and the second arrest portion 74*c*. The first arrest portion 74*b* is caught by an upper surface of the second fastening plate 35, a surface of the second fastening plate 35 facing the first fastening plate 33, the second arrest portion 74*c* is caught by a lower surface of the second fastening plate 35, the opposite surface of the second fastening plate 35 facing the first fastening plate 33, and the buffer portion 74*f* protrudes downwardly from the second fastening plate 35, is mounted on the base cover 1*e*, and absorbs vibrations transmitted to the base cover 1*e* when at least one of the drain pump 36 and the circulation pump 34 is driven.

The first arrest portion 74*b* and the second arrest portion 74*c* protrude in a radial direction of the mount 70. A plurality of first arrest portions 74*b* are formed to be spaced apart from each other in a circumferential direction of the mount 70, and a plurality of second arrest portions 74*c* are formed to be spaced apart from each other in a circumferential direction of the mount 70. Also, a plurality of first arrest portions 74*b* may be formed to be spaced apart from each other in the circumferential direction of the mount 70 and only a single second arrest portion 74*c* may be continuously formed in the circumferential direction of the mount 70. Conversely, only one first arrest portion 74*b* may be continuously formed in the circumferential direction of the mount 70, and a plurality of second arrest portions 74*c* may be formed to be spaced apart from each other in the circumferential direction of the mount 70.

The first arrest portion 74*b* may be formed such that a front end thereof inserted into the second fastening hole 35*a* is formed as a sloped surface 74*g*, so that the soft part 74 may be easily inserted into the second fastening hole 35*a*.

The buffer portion 74*f* includes an extending portion (or flange) 74*d* extending from the second arrest portion 74*c* in an axial direction and a contact portion (or cushion) 74*e* protruding from an end portion of the extending portion 74*d* in a radial direction so as to come into contact with the base cover 1*e* of the cabinet. Preferably, the extending portion 74*d* protrudes downwardly from the second arrest portion 74*c* by a predetermined length sufficient for absorbing vibrations transmitted from the pump unit 30 to the base cover 1*e*.

As described above, in the laundry treating apparatus according to an embodiment of the present disclosure, since the mount 70 directly couple the pump unit 30 to the cabinet 1, vibrations may be reduced, a space allowing the automatic injection device 20 to be installed therein may be secured, and costs may be reduced.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

An aspect of the present disclosure provides a laundry treating apparatus in which vibrations are reduced. Another aspect of the present disclosure provides a laundry treating apparatus in which a component installation space is secured. Another aspect of the present disclosure provides a laundry treating apparatus incurring low cost by reducing the number of components. Technical subjects of the present disclosure that may be obtained in the present disclosure are not limited to the foregoing technical subjects and any other technical subjects not mentioned herein may be easily understood by a person skilled in the art from the present disclosure and accompanying drawings.

In an aspect, a laundry treating apparatus may include: a tub holding washing water; a drum rotatably disposed within the tub and holding laundry; a nozzle jetting the washing water to an interior of the drum; a pump unit having a pump body, a drain pump coupled to the pump body and outwardly draining washing water introduced from the interior of the tub to the pump body, and a circulation pump coupled to the pump body and supplying washing water introduced from the interior of the tub to the pump body to the nozzle; a cabinet accommodating the tub, the drum, the nozzle, and the pump unit therein; and a mount coupled to the pump body and the cabinet to absorb vibrations.

In the laundry treating apparatus according to an embodiment of the present disclosure, since the mount directly couples the pump unit to the cabinet, vibrations may be reduced. Also, a space in which the automatic injection device is installed may be secured. Also, costs may be reduced.

Advantages and effects of the present disclosure that may be obtained in the present disclosure are not limited to the foregoing effects and any other technical effects not mentioned herein may be easily understood by a person skilled in the art from the present disclosure and accompanying drawings.

Any reference in this specification to "one embodiment," "an embodiment," "example embodiment," etc., means that a particular feature, structure, or characteristic described in connection with the embodiment is included in at least one embodiment of the present disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a tub;

a pump assembly having a pump body receiving water from the tub, a drain pump coupled to the pump body and draining water in the pump body, a circulation pump coupled to the pump body, and a fastening mount protruded from the pump body;

a cabinet to house the tub and the pump assembly; and a support leg to couple the fastening mount and the cabinet and to absorb vibrations between the pump assembly and the cabinet, wherein the support leg extends in a vertical direction, wherein the support leg includes:

a rigid head; and a deformable stem provided downward of the rigid head, and made of material softer than the rigid head, and wherein the rigid head is positioned in a mold pattern when the deformable stem is molded in the mold pattern such that the rigid head and the deformable stem are formed integrally.

2. The laundry treating apparatus of claim 1, further comprising:

a fastener coupling the support leg to the cabinet.

3. The laundry treating apparatus of claim 2, wherein the cabinet includes a base cover forming a bottom surface of the cabinet, the support leg is coupled to the base cover, and the fastener is inserted through an opening in the base cover and engages an opening in the support leg.

4. The laundry treating apparatus of claim 1, wherein the cabinet includes a base cover forming a bottom surface of the cabinet, and the support leg is coupled to the base cover.

5. The laundry treating apparatus of claim 1, wherein the fastening mount includes a first fastening plate having a first fastening hole and a second fastening plate disposed to be parallel to the first fastening plate and having a second fastening hole.

6. The laundry treating apparatus of claim 5, wherein the rigid head inserted into the first fastening hole when the support leg is received in the fastening mount; and the deformable stem inserted into the second fastening hole when the support leg is received in the fastening mount.

7. The laundry treating apparatus of claim 6, wherein the rigid head is formed from a metal or a plastic.

8. The laundry treating apparatus of claim 6, wherein the deformable stem is formed from rubber.

9. The laundry treating apparatus of claim 6, wherein the rigid head includes:

a circular base; and at least one protrusion extending from an outer circumferential surface of the base in a radial direction, and wherein the protrusion engages a portion of the first fastening plate when the support leg is received by the fastening mount to discourage a rotation of the support leg within the fastening mount.

10. The laundry treating apparatus of claim 6, wherein the deformable stem includes:

a groove corresponding to the second fastening hole;

a first arrest extension formed on one side of the groove and caught by a surface of the second fastening plate facing the first fastening plate when the support leg is received by the fastening mount;

a second arrest extension formed on another side of the groove and caught by an opposite surface of the second fastening plate facing the first fastening plate when the support leg is received by the fastening mount; and a buffer base extending from the second arrest extension so as to be in contact with the cabinet.

11. The laundry treating apparatus of claim 10, wherein the buffer base includes:

an extending flange extending from the second arrest extension in an axial direction; and a contact cushion protruding from an end portion of the extending flange in a radial direction so as to be in contact with the cabinet when the support leg couples the pump assembly to the cabinet.

12. The laundry treating apparatus of claim 10, wherein the support leg includes at least one of a plurality of first arrest extensions or a plurality of second arrest extensions, and the plurality of first fastening extensions or the plurality of second fastening extensions are spaced apart from each other in a circumferential direction of the support leg.

13. The laundry treating apparatus of claim 10, wherein the first arrest extension includes a sloped surface formed in a front end to be inserted into the second fastening hole.

14. A laundry treating apparatus comprising:

a tub;

a pump assembly having a pump body to receive water from the tub, a drain pump coupled to the pump body, a circulation pump coupled to the pump body, and a fastening mount protruded from the pump body;

a cabinet to house the tub and the pump assembly;

a support leg that is received in the fastening mount, the support leg including:

a rigid head; and a deformable stem formed of material softer than the rigid head, the deformable stem having a cavity that extends between a first opening and a second opening of the deformable stem, a portion of the rigid head being received in the cavity via the first opening; and a fastener that is configured to be inserted through an opening in a bottom surface of the cabinet and into the second opening of the deformable stem to couple the support leg to the bottom surface of the cabinet.

15. The laundry treating apparatus of claim 14, wherein:

the rigid head includes a cylinder base, and at least one protrusion radially extending from an outer surface of the cylinder base, and the fastener, when inserted into the cavity of the deformable head, applies positions the protrusion of the rigid head into a slot formed in the fastening mount.

16. The laundry treating apparatus of claim 14, wherein the fastening mount includes a first fastening plate having a first fastening hole, a second fastening plate extending parallel to the first fastening plate and having a second fastening hole, and a vertical wall coupling the first fastening plate and the second fastening plate, and wherein, when the support leg is received in the fastening mount, the rigid head is inserted into the first fastening hole, and the deformable stem is inserted into the second fastening hole.

17. The laundry treating apparatus of claim 16, wherein the rigid head includes a cylinder base; and at least one protrusion extending radially from an outer circumferential surface of the base, and wherein the at least one protrusion engages an interior surface of the first fastening hole when the support leg is received in the fastening mount.

18. The laundry treating apparatus of claim 16, wherein the deformable stem includes:

a groove having a shape corresponding to the second fastening hole;

a first arrest extension formed on one side of the groove to engage a surface of the second fastening plate facing the first fastening plate when the support leg is received by the fastening mount;

a second arrest extension formed on another side of the groove to engage an opposite surface of the second fastening plate when the support leg is received by the fastening mount; and a buffer base extending from the second arrest extension so as to contact the cabinet.

19. The laundry treating apparatus of claim 18, wherein the buffer base includes:

an extending flange extending from the second arrest extension in an axial direction; and a contact cushion protruding from an end portion of the extending flange in a radial direction so as to contact the cabinet when the support leg is coupled to the cabinet.

20. The laundry treating apparatus of claim 18, wherein the first arrest extension includes a sloped surface formed in a front end to be inserted into the second fastening hole.

* * * * *